US008459964B2

(12) United States Patent
Jung et al.

(10) Patent No.: US 8,459,964 B2
(45) Date of Patent: Jun. 11, 2013

(54) NOISE REDUCING DEVICE FOR HERMETIC TYPE COMPRESSOR

(75) Inventors: Min-Kyu Jung, Changwon (KR); Jea-Young Choi, Changwon (KR)

(73) Assignee: LG Electronics Inc., Seoul (KR)

( * ) Notice: Subject to any disclaimer, the term of this patent is extended or adjusted under 35 U.S.C. 154(b) by 244 days.

(21) Appl. No.: 12/812,296

(22) PCT Filed: Dec. 31, 2008

(86) PCT No.: PCT/KR2008/007894

§ 371 (c)(1),
(2), (4) Date: Jul. 9, 2010

(87) PCT Pub. No.: WO2009/088180

PCT Pub. Date: Jul. 16, 2009

(65) Prior Publication Data

US 2010/0290928 A1 Nov. 18, 2010

(30) Foreign Application Priority Data

Jan. 10, 2008 (KR) ..... 10-2008-0003141

(51) Int. Cl.
*F04B 53/00* (2006.01)

(52) U.S. Cl.
USPC ..... 417/312; 417/902; 181/403

(58) Field of Classification Search
USPC ..... 417/312, 902; 181/403
See application file for complete search history.

(56) References Cited

U.S. PATENT DOCUMENTS

| | | | | |
|---|---|---|---|---|
| 5,947,072 | A * | 9/1999 | Loy et al. | 123/184.56 |
| 2004/0103683 | A1 * | 6/2004 | Yoon | 62/296 |
| 2005/0042113 | A1 * | 2/2005 | Lee | 417/312 |
| 2005/0142002 | A1 * | 6/2005 | Kang et al. | 417/312 |
| 2007/0029135 | A1 * | 2/2007 | Ermer et al. | 181/269 |

FOREIGN PATENT DOCUMENTS

| | | |
|---|---|---|
| WO | WO 2007/083905 | 7/2007 |
| WO | WO 2007083905 A1 * | 7/2007 |

OTHER PUBLICATIONS

International Search Report issued in PCT/KR2008/007894 dated May 14, 2010.

* cited by examiner

*Primary Examiner* — Peter J Bertheaud
*Assistant Examiner* — Dominick L Plakkoottam
(74) *Attorney, Agent, or Firm* — KED & Associates LLP

(57) ABSTRACT

A noise reducing device for a hermetic type compressor is provided that includes a plate film in a connection member that connects a suction pipe and a suction muffler to each other. The plate film bends and opens when a refrigerant is sucked while preventing a back flow of noise. The plate film is capable of sucking the refrigerant without interference and preventing noise or pressure pulsation transferred in a direction of the suction pipe in the suction muffler, and thereby is capable of remarkably reducing noise of the compressor.

20 Claims, 4 Drawing Sheets

NOISE REDUCING DEVICE FOR HERMETIC TYPE COMPRESSOR

TECHNICAL FIELD

The present invention relates to a noise reducing device for a hermetic type compressor which is capable of reducing noise by being installed at a suction side of the hermetic type compressor.

BACKGROUND ART

Generally, a hermetic type compressor has a suction side provided with a suction muffler for reducing valve noise, flow-induced noise or pressure pulsation which may be generated when a refrigerant is sucked into a compression mechanism unit. The suction muffler includes a noise space in which noise generated at the time of refrigerant suctioning is reduced, an inlet formed at one side of the noise space and connected to a suction pipe of a refrigerating cycle, and an outlet formed at the other side of the noise space and connected to a suction side of the compression mechanism unit. The noise space may be partitioned into a plurality of spaces as necessary. Alternately, the plurality of noise spaces may be formed in series or in parallel.

The suction muffler may be classified into a direct suction type and indirect suction type according to a manner applied to a compressor. The direct suction type suction muffler is configured to have an inlet closely disposed at a suction pipe penetratingly coupled to a hermetic container of the compressor so that a refrigerant may be directly sucked into the compression mechanism unit, while the indirect suction type suction muffler is configured to have the suction pipe spaced from the inlet of the suction muffler by a constant gap so that the refrigerant may be sucked into the compression mechanism unit by passing through an inner space of the hermetic container of the compressor.

DISCLOSURE OF INVENTION

Technical Problem

However, in the related direct suction type suction muffler, as the suction pipe is directly connected to the inlet of the suction muffler, pressure pulsation transferred through the suction muffler or vibration noise caused by the pressure pulsation is transferred to the suction pipe and then the pressure pulsation or the vibration noise is transferred to a casing through the suction pipe, thereby increasing noise of the compressor.

Therefore, it is an object of the present invention to provide a noise reducing device for a hermetic compressor which is capable of effectively reducing pressure pulsation or vibration noise generated from a compression mechanism unit in a suction muffler as well as of facilitatingly sucking a refrigerant into the compression mechanism unit through the suction muffler.

Technical Solution

To achieve the object, in accordance with one aspect of the present invention, there is provided a noise reducing device for a hermetic type compressor comprising: a hermetic container to which a suction pipe is penetratingly coupled; a compressor main body installed in the hermetic container; a suction muffler disposed at a suction side of the compressor main body; and a connection member interposed between the suction pipe and an inlet of the suction muffler and having at least one plate film for controlling flow of a refrigerant.

In accordance with another aspect of the present invention, there is provided a noise reducing device for a hermetic type compressor comprising: a hermetic container to which a suction pipe is penetratingly coupled; a compressor main body installed in the hermetic container; a suction muffler disposed at a suction side of the compressor main body and connecting the suction side of the compressor main body and the suction pipe to each other; and a connection member installed between the suction muffler and the suction pipe and directly connecting the suction muffler and the suction pipe to each other, wherein a plate film is provided so as to switch a refrigerant passage disposed in the hermetic container.

Advantageous Effects

According to a noise reducing device for a hermetic type compressor of the present invention, a plate film is formed in a connection member connecting a suction pipe and a suction muffler to each other, the plate film configured to prevent a back flow of noise by being bent and open when a refrigerant is sucked and then closed when the suction of the refrigerant is finished. Accordingly, it is capable of facilitatingly sucking the refrigerant without interference and of reducing pressure pulsation or noise by blocking the pressure and noise transferred toward the suction pipe in the suction muffler, thereby being capable of remarkably reducing noise of the compressor.

BEST MODE FOR CARRYING OUT THE INVENTION

Hereafter, description will now be given in detail of a noise reducing device for a hermetic compressor according to the present invention with accompanying drawings.

Figure 1:
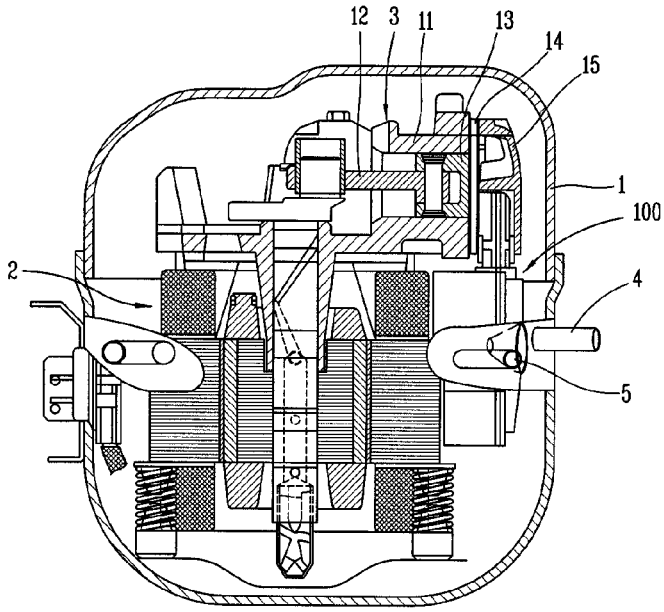
FIG. 1 is a longitudinal section view showing a reciprocating compressor to which a suction muffler having a connection member is applied in accordance with the present invention.

As shown in FIG. 1, a reciprocating compressor having a noise reducing device according to the present invention includes a compressor hermetic container 1, a driving motor 2 installed in the compressor hermetic container 1, and a compressor main body 3 including a cylinder block 11 for compressing a refrigerant by receiving a driving force from the driving motor 2, a connecting rod 12, a piston 13, a valve assembly 14, a discharge cover 15, a suction muffler 100 and the like.

Figure 2:
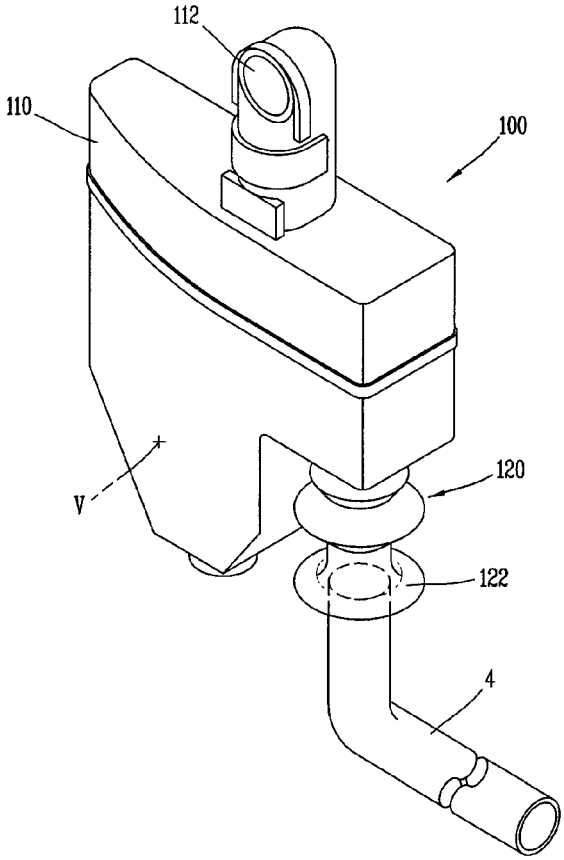
FIG. 2 is a perspective view showing a suction muffler in accordance with FIG. 1.

As shown in FIG. 2, the suction muffler 100 includes a case 110 installed in an inner space of the compressor hermetic container 1 and having a noise space (V) for reducing noise generated from the compressor main body 3, a communication pipe (not shown) installed in the noise space (V) of the case 110 so as to partition the noise space (V) into a plurality of chambers and to guide the refrigerant into the compressor main body 3, and a connection member 120 coupled to an inlet 111 of the case 110 and having an inlet directly connected to a suction pipe 4 penetrating the compressor hermetic container 1.

Figure 3:
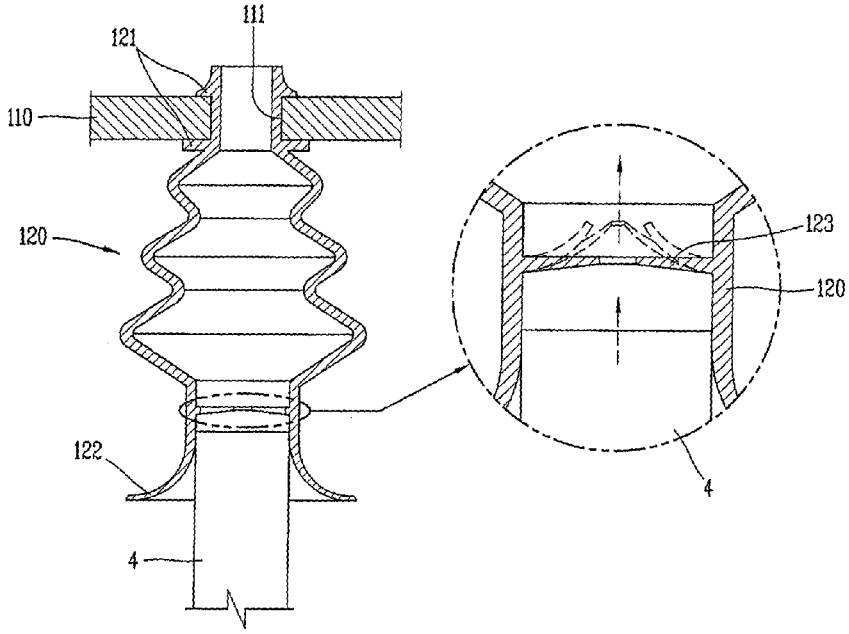
FIG. 3 is a longitudinal section view showing a connection member in the suction muffler in accordance with FIG. 2.

As shown FIGS. 2 and 3, the case 110 is configured to have the inlet 111 formed at a lower case and the outlet 112 formed at an upper case coupled to the compressor main body 3 by being coupled to the lower case. The inlet 111 is configured to penetrate the lower case and the outlet 112 is extended from an upper surface of the upper case.

Here, the communication pipe (not shown) is configured to partition the noise space (V) into a plurality of chambers and be consecutively communicated with the plurality of chambers so that the refrigerant may be guided to the compressor main body 3 by passing through the noise space (V).

Figure 4:
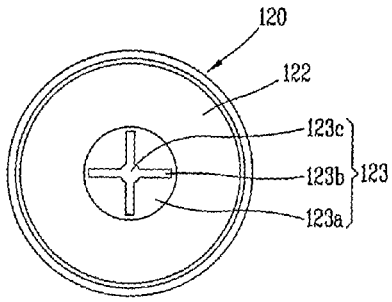
FIG. 4 is a bottom view showing a connection member in accordance with FIG. 3.

The connection member 120, as shown in FIGS. 3 and 4, is implemented as a corrugated tube using a flexible material having elasticity and is configured to have a sectional area becoming smaller in a direction of the inlet 111 of the suction muffler 100. And, the connection member 120 has an outer circumferential surface of one end provided with fixing protrusions 121 to be inserted into the inlet 111 of the suction muffler 100 and coupled thereto. The plurality of fixing protrusions 121 may be spaced from each other by specific gaps therebetween so as to be respectively locked by an outer side surface of an inside of the inlet 111 of the suction muffler 100.

And, the connection member 120 is configured to have an expanded portion 122 formed by expanding the inlet side. And then, an outlet portion of the suction pipe 4 is inserted toward the inside of the expanded portion 122 so that the expanded portion 122 and the suction pipe 4 may be integrally coupled to each other or the suction pipe 4 may be inserted into the expanded portion 122 with a slight gap between an outer circumferential surface of the suction pipe 4 and an inner circumferential surface of the expanded portion 122.

A plate film 123 is formed in the connection member 120. The plate film 123 is configured to be bent in a suction direction of the refrigerant when the refrigerant is sucked and to be elastically restored when the refrigerant is not sucked, thereby blocking pressure pulsation or noise.

The plate film 123 may be integrally formed with the connection member 120 formed of the flexible material having elasticity or may be assembled to the connection member 120 after being separately formed of a flexible material having elasticity.

As shown in FIGS. 3 and 4, the plate film 123 is configured to have a circumstance connected to the inner circumferential surface of the connection member 120 so that a central portion thereof can be bent. And, the central portion of the plate film 123 is cut and thus implemented as at least three plate film pieces 123*a* (four in the drawing). To this end, the plate film 123 is cut in a cross shape and a central portion of the cut surfaces 123*b* is provided with a refrigerant flow groove 123*c* larger than a gap of the cut surfaces 123*b*.

The plate film pieces 123*a*, as shown in FIG. 3, are configured to have a portion coming in contact with the inner circumferential surface of the connection member 120, which is to be relatively thicker than an end of a side of the refrigerant flow groove 123*c*, so as to increase a reaction velocity when the plate film pieces 123*a* are closed, preferably. And, in this case, the plate film pieces 123*a* have a side surface at a flow direction side of the refrigerant in an inclined shape and have the opposite side surface in a flat shape so that the plate film surfaces 123*a* can be rapidly closed. Accordingly, it is capable of reducing a flow resistance of the refrigerant and of enhancing resisting force with respect to the reverse-flowing pulsation pressure or the vibration noise.

Unexplained reference numeral 5 denotes a discharge pipe.

The suction muffler of the hermetic type compressor according to the present invention has the following operations and effects.

Once a compression mechanism unit (not shown) installed in the compressor hermetic container 1 is operated, a refrigerant circulating a refrigerating cycle is directly introduced into the suction muffler 100 and the noise space (V) through the suction pipe 4 and a suction guide pipe 130. The refrigerant sequentially passes through the plurality of chambers with flowing along the communication pipe and then is sucked into the compression space of the compressor main body 3 through the outlet 112.

Here, as the suction pipe 4 is directly connected to the connection member 120 mounted at the inlet 111 of the suction muffler 100 or is disposed at an adjacent position, the refrigerant passing through the suction pipe 4 is directly sucked into the noise space (V) of the suction muffler 100 by passing through the connection member 120.

Figure 5:
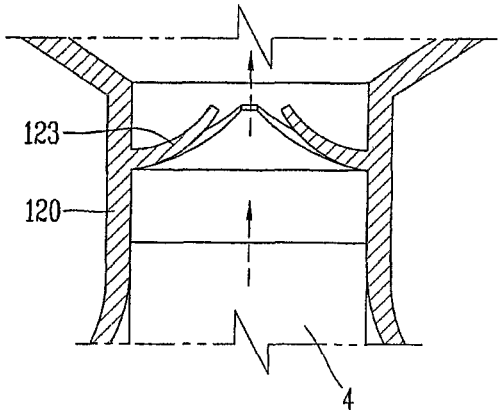
FIGS. 5 and 6 are schematic views respectively showing that a refrigerant is sucked and that a back flow of noise is prevented in the connection member in accordance with FIG. 2.

Here, the plate film 123 is formed in the connection member 120 connecting the suction pipe 4 and the inlet 111 of the suction muffler 100 to each other. As the plate film 123 is cut to be bent in a flow direction of the refrigerant, as shown in FIG. 5, the refrigerant can be facilitatingly sucked without interference.

Figure 6:
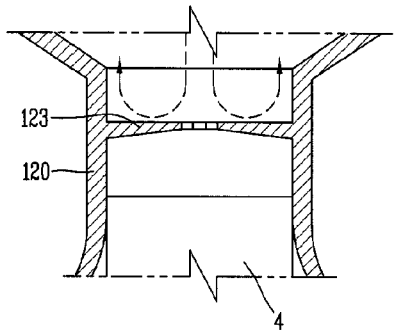

Pressure pulsation and valve noise are generated resulting from that a suction valve is closed at the time that the compressor main body 3 completes the suction process. The pressure pulsation and the valve noise are transferred in a direction which is opposite to a direction that the refrigerant is sucked. However, the plate film 123 disposed in the connection member 120 is restored into its original state by an elastic force of itself, as shown in FIG. 6, accordingly a passage of the refrigerant is partially blocked. Accordingly, the pressure pulsation or the noise having been transferred toward the suction pipe 4 from the suction muffler 100 is offset by the plate film 123, and accordingly it is capable of preventing the pressure pulsation or the noise from being transferred to the outside of the compressor hermetic container 1, thereby being capable of remarkably reducing the noise of the compressor.

MODE FOR THE INVENTION

Meanwhile, another embodiment of the plate film in the noise reducing device for the hermetic type compressor in accordance with the present invention will be explained as follows.

Figure 7:
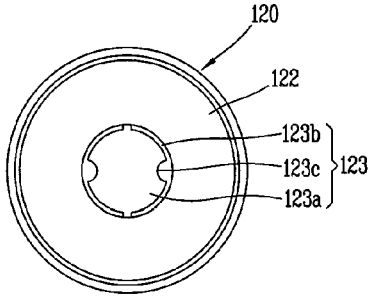
FIG. 7 is a bottom view showing another embodiment of a connection member in accordance with FIG. 2.
Figure 8:
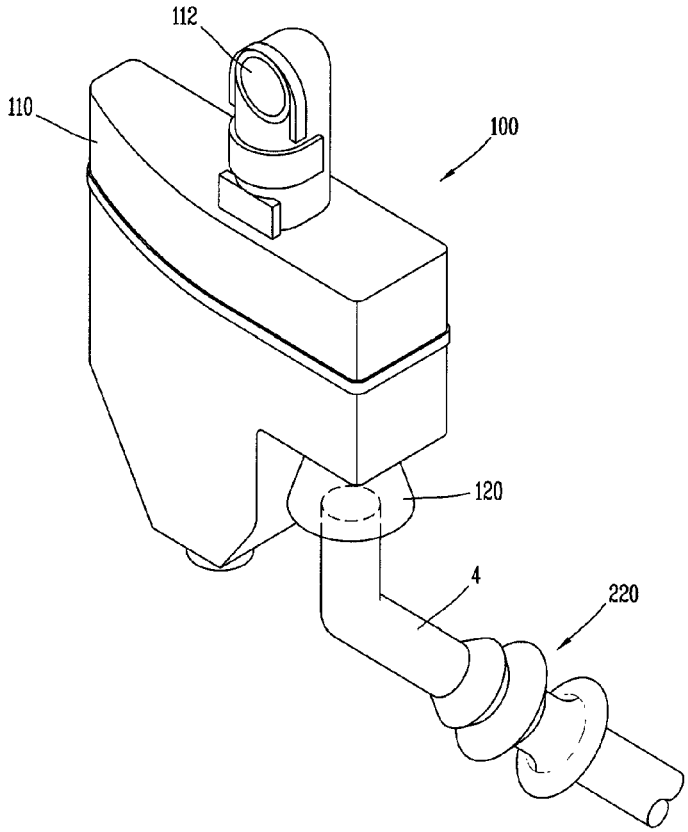
FIG. 8 is a perspective view showing another embodiment of a suction muffler in which a connection member is coupled to another position in the reciprocating compressor in accordance with FIG. 1.

In the aforementioned embodiment, the plate film is configured to have the central portion bent centering around the inner circumferential surface of the connection member. In this embodiment, the plate film 123 is configured to be bent toward both sides centering around the central portion of itself, as shown in FIG. 7. To this end, the central portion of the plate film 123 is connected to the inner circumferential surface of the connection member 120 and both sides of the central portion are cut. Thus, the plate film 123 is formed of at least two plate film pieces 123*a*. Cut surfaces 123*b* of the plate film pieces 123*a* may be provided with refrigerant flow grooves 123*c* larger than a gap of the cut surfaces 123*b*. Operations and effects thereof are same as those of the aforementioned embodiment, thus detailed explanation will be omitted.

Meanwhile, another embodiment regarding an installation position of the connection member in the noise reducing device for the hermetic type compressor in accordance with the present invention will be explained as follows.

In the aforementioned embodiment, the connection member is assembled to the inlet of the suction muffler. In this embodiment, the connection member 220 may be interposed at the middle of the suction pipe 4. In this case, the connection member 200 is formed in a corrugated tube shape using a flexible material. And, a plate film (not shown) same as the aforementioned may be formed in the connection member 220. The plate film may be formed in a shape same as the aforementioned, thus detailed explanation will be omitted. And, since operations and effects of the noise reducing device of the hermetic type compressor according to this embodiment are same those of the aforementioned embodiment, thus detailed explanation will be omitted. However, in this case, since the refrigerant sucked through the suction pipe 4 should be directly sucked into the suction muffler 100, the inlet 111 (see FIG. 3) of the suction muffler 100 may be further provided with another connection member even if the connection member having the plate film or the plate film is not provided thereat as aforementioned embodiment, preferably.

INDUSTRIAL APPLICABILITY

The noise reducing device in accordance with the present invention may be broadly applied to hermetic type compressors in which a suction pipe and a compressor main body are directly connected to each other.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A noise reducing device for a hermetic type compressor, the device comprising:

a hermetic container to which a suction pipe is penetratingly coupled;

a compressor main body disposed in the hermetic container;

a suction muffler disposed at a suction side of the compressor main body; and a connection member disposed between the suction pipe and an inlet of the suction muffler; and at least one plate film disposed within the connection member, that controls flow of a refrigerant, wherein the at least one plate film is formed of a flexible material so as to be bent by sucked refrigerant, wherein the at least one plate film comprises an inclined surface on an insertion side of the refrigerant, the inclined surface extending at an incline from an inner circumferential surface of the connection member to a central portion of the at least one plate film and a flat surface opposite to the inclined surface, the flat surface extending substantially perpendicular to the inner circumferential surface of the connection member, such that a thickness of the at least one plate film becomes gradually thinner as it extends toward the central portion of the at least one plate film.

2. The device of claim 1, wherein the at least one plate film is configured to have a circumference connected to the inner circumferential surface of the connection member so that the central portion of the at least one plate film bends when the refrigerant is sucked, and wherein the central portion of the at least one plate film is cut, and thus, implemented as at least three plate film pieces.

3. The device of claim 2, wherein the central portion of the at least one plate film includes a refrigerant flow groove larger than a gap between cut surfaces thereof.

4. The device of claim 1, wherein the at least one plate film is configured to have the central portion connected to the inner circumferential surface of the connection member such that both sides thereof are bent centering around the central portion, and wherein the at least one plate film is formed of two or more plate film pieces as both sides of the central portion are cut.

5. The device of claim 4, wherein cut surfaces of the two or more plate film pieces are provided with refrigerant flow grooves larger than a gap between the cut surfaces.

6. The device of claim 1, wherein the connection member is formed in a corrugated tube shape using a flexible material.

7. The device of claim 1, wherein the connection member is configured to have a sectional area that becomes smaller in a direction of the inlet of the suction muffler.

8. The device of claim 1, wherein the connection member is configured to have one end inserted into the inlet of the suction muffler and coupled thereto.

9. The device of claim 8, wherein the connection member is provided with fixing protrusions so as to be respectively locked by an outer surface and an inner surface of the inlet of the suction muffler.

10. The device of claim 1, wherein the connection member includes an expanded portion formed by expanding an inlet side thereof.

11. The device of claim 10, wherein the suction pipe is inserted into an inside of the inlet side expanded portion of the connection member.

12. The device of claim 1, wherein the connection member includes a first portion formed in a corrugated tube shape and a second portion formed by expanding an inlet side thereof, and wherein the at least one plate film is positioned downstream of the second portion with respect to a direction of refrigerant flow and upstream of the first portion.

13. The device of claim 1, wherein the at least one plate film elastically restores and blocks pressure pulsations and noise when the refrigerant is not sucked.

14. The device of claim 1, wherein the suction muffler includes a case installed in an inner space of the hermetic container and having a noise space to reduce noise generated from the compressor main body.

15. The device of claim 14, wherein the case comprises the inlet formed at a lower portion of the case and an outlet formed at an upper portion of the case.

16. The device of claim 1, wherein the at least one plate film includes at least two cut out portions.

17. The device of claim 16, wherein the at least two cut out portions extend perpendicular to one another to form a cross shape with a refrigerant flow groove formed at the central portion of the at least one plate film.

18. The device of claim 16, wherein the at least two cut out portions form four plate film pieces connected to the inner circumferential surface of the connection member.

19. The device of claim 16, wherein the at least two cut out portions comprise two substantially semicircular cut out portions that extend along the inner circumferential surface of the connection member to form a single plate film piece attached to the inner circumferential surface of the connection member at at least two points.

20. The device of claim 19, wherein each of the two substantially semicircular cut out portions includes a refrigerant flow groove.

* * * * *